United States Patent [19]

Danazcko et al.

[11] Patent Number: 4,913,238

[45] Date of Patent: Apr. 3, 1990

[54] FLOATING/TENSIONED PRODUCTION SYSTEM WITH CAISSON

[75] Inventors: Mark A. Danazcko; Robert E. Haring; Roger W. Huffaker, all of Houston, Tex.

[73] Assignee: Exxon Production Research Company, Houston, Tex.

[21] Appl. No.: 340,181

[22] Filed: Apr. 18, 1989

[51] Int. Cl.[4] ..... E21B 7/128; E21B 43/01; B63B 35/44

[52] U.S. Cl. ..... 166/350; 166/355; 166/356; 166/358; 175/7; 175/8; 405/195

[58] Field of Search ..... 166/352, 350, 354, 355, 166/356, 358, 359; 175/7, 8; 405/195, 200, 205, 211, 224

[56] References Cited

U.S. PATENT DOCUMENTS

| | | | |
|---|---|---|---|
| 3,372,745 | 3/1968 | Holmes | 166/5 |
| 3,412,564 | 11/1968 | McClintock | 61/46.5 |
| 3,450,201 | 6/1969 | Blenkarn | 166/5 |
| 3,472,032 | 10/1969 | Howard | 166/357 |
| 3,638,720 | 2/1972 | Thomas | 166/350 |
| 3,902,553 | 9/1975 | Jergins | 166/0.5 |
| 4,098,333 | 7/1978 | Wells et al. | 175/7 |
| 4,158,516 | 6/1979 | Noblanc et al. | 405/196 |
| 4,170,266 | 10/1979 | Fayren | 175/7 |
| 4,305,468 | 12/1981 | Goldsmith | 166/359 |
| 4,391,332 | 7/1983 | Fayren | 166/350 |
| 4,407,579 | 9/1977 | Wilckens et al. | 175/7 |
| 4,516,882 | 5/1985 | Brewer et al. | 405/22.4 |
| 4,646,841 | 3/1987 | Schawann et al. | 166/355 |
| 4,702,321 | 10/1987 | Horton | 175/8 |
| 4,762,180 | 8/1988 | Wybro et al. | 166/350 |
| 4,780,026 | 10/1988 | Gunderson | 405/224 |

FOREIGN PATENT DOCUMENTS

| | | | |
|---|---|---|---|
| 2156283A | 10/1985 | United Kingdom . | |
| 2157749 | 10/1985 | United Kingdom | 166/350 |
| 21896901A | 8/1987 | United Kingdom . | |
| 2196676A | 5/1988 | United Kingdom . | |

OTHER PUBLICATIONS

Buckman, D., "New Concept: Dynamic Mooring-Positioning System for Fixed, Compliant Modes for Platform", Ocean Industry, pp. 67-69, Mar. 1976.

Telecopy Disclosure from Earl & Wright Consulting Engineers dated Jul. 14, 1988.

Telephone Disclosure from Paul Geiger of Friede & Goldman on Jul. 5, 1988.

Disclosure dated Aug. 1988 (received at EPR 11-1-7-88) entitled "Deepwater Floating Production System with Surface Wellheads" by Friede & Goldman.

*Primary Examiner*—Bruce M. Kisliuk

*Attorney, Agent, or Firm*—Sheila M. Luck

[57] ABSTRACT

A floating/tensioned production system for use in deepwater drilling and production operations generally combining a relatively small tension leg platform with a semisubmersible platform. The semisubmersible platform is provided with a working deck supported above the water surface so that an air gap exists between the working deck and the water surface. The tension leg platform provides a heave-restrained production deck for near-surface wellhead equipment. The production deck is supported above the drill site but beneath the water surface by buoyancy members and held in place by one or more tethers. Most other drilling and production equipment is located on the semisubmersible working deck. A caisson, surrounding the production deck, is used to provide a substantially dry working area. In one embodiment, the caisson is retractably attached to the production deck. In an alternative embodiment, the caisson is attached to the bottom of the working deck, extending downwardly to sealingly engage with the production deck.

52 Claims, 5 Drawing Sheets

12
30
66
66
6
2
34
47
8
8
2
36
2
16
16
22
38
42
20
40
20
38
4
5
10
10
14
14
28
32
26
24
18

FLOATING/TENSIONED PRODUCTION SYSTEM WITH CAISSON

FIELD OF THE INVENTION

The present invention relates to offshore petroleum drilling and production systems. More specifically, the present invention combines the advantages of a tension leg platform with those of a floating production system to produce a floating/tensioned drilling and production system for use in deepwater.

BACKGROUND OF THE INVENTION

In recent years there has been a continuing effort to produce crude oil and gas from subterranean formations located in ever-increasing water depths. One approach to producing hydrocarbons from deepwater fields is to locate the wellheads on the seafloor using subsea production equipment. However, as the water depth exceeds the capability of divers, accessing the wellheads for servicing and workovers becomes more difficult and more costly, resulting in the need for submarines, remotely operated vehicles, or the like.

Another approach to producing hydrocarbons from deepwater fields is to extend the well casing strings through the water column and locate the wellheads above the water surface, commonly called surface wellheads. Surface wellheads are generally preferred for deepwater offshore production because they have less complex drilling and production equipment and reduced maintenance costs. However, the structure required to support surface wellheads becomes increasingly expensive as water depth increases.

During the past few years there have been a number of developments in deepwater oil and gas production technology, including the semisubmersible floating production platform. The semisubmersible floating production platform consists of a flotation hull and deck. The flotation hull typically has four or more large diameter vertical columns which extend downwardly from the deck and are supported on two or more horizontal pontoons. The flotation hull, when de-ballasted, allows the platform to be floated to the drill site. At the site, the hull is ballasted with seawater such that it becomes partially submerged, with the platform deck remaining above the water surface. The semisubmersible platform is held in position using mooring lines. Submerging the flotation hull beneath the water surface reduces the effect of environmental forces such as wind and waves and results in a relatively stable work deck. However, while stable for most drilling and production operations, the semisubmersible platform still responds to the environment to an extent such that surface wellheads are unattractive due to the complexity and cost of the riser tensioner and other clearance systems required to permit relative motion between the platform and foundation. Instead, relatively complex and costly subsea production equipment is typically used with the semisubmersible platform to produce hydrocarbons from semisubmersible floating production platforms.

Tension leg platforms ("TLP's") are another technology used to produce hydrocarbons in deep water. The TLP is a platform for drilling and production operations that is moored to the seafloor using stiff, vertical tethers (also commonly called "tendons"). The TLP hull and deck, which together comprise the platform, are similar in configuration, construction, and hydrodynamic properties to the semisubmersible floating production platform. The hull provides excess buoyancy to support the deck and to tension the tethers and production risers. The deck supports drilling and production facilities. Mooring the platform using stiff, vertical tethers, which are tensioned by the excess buoyancy of the hull, virtually eliminates heave, roll, and pitch motions. As a result, a heave-restrained platform is provided which permits surface wellheads to be used with all of their operational benefits. Heave restraining the entire platform, including the drilling rig, crew's quarters, and ancillary production equipment, requires a substantial amount of additional buoyancy and tether steel, thereby increasing the overall cost of the TLP to a point which is great compared to the operational benefit gained.

Because most of the petroleum drilling and production equipment typically used on an offshore platform is not greatly affected by heave, it would be desirable to eliminate many of the difficulties associated with producing deepwater oil fields by combining the heave restraining benefit of the TLP with the reduced cost benefit of the semisubmersible floating production platform by heave restraining only the surface wellhead equipment.

SUMMARY OF THE INVENTION

The present invention is a floating/tensioned production system for use in deepwater oil production. In a preferred embodiment, the inventive production system comprises a relatively small tension leg platform combined with a semisubmersible floating production platform. The tension leg platform provides a heave-restrained deck for surface wellhead equipment. Most other equipment of the production system is located on the semisubmersible floating production platform. Preferably the tension leg platform's production deck is anchored underneath the working deck of the semisubmersible platform and beneath the water surface. A caisson surrounding the production deck is used to provide a substantially water-free working area. In one embodiment, the caisson is retractably connected to the production deck of the tension leg platform and it extends upwardly from the production deck, between the buoyancy chambers of the flotation means of the semisubmersible platform, to a point above the water's surface but below the working deck. Alternatively, the caisson may be suspended from the bottom of the semisubmersible platform's working deck, extending downwardly, to sealingly engage with the production deck of the tension leg platform.

DESCRIPTION OF THE DRAWINGS

The actual operation and advantages of the present invention will be better understood by referring to the following detailed description and the attached drawings in which.

While the invention will be described in connection with the preferred embodiments, it will be understood that the invention is not limited thereto. On the contrary, the invention is intended to cover all alternatives, modifications and equivalents which may be included within the spirit and scope of the invention.

DETAILED DESCRIPTION OF THE PREFERRED EMBODIMENT

Figure 1:
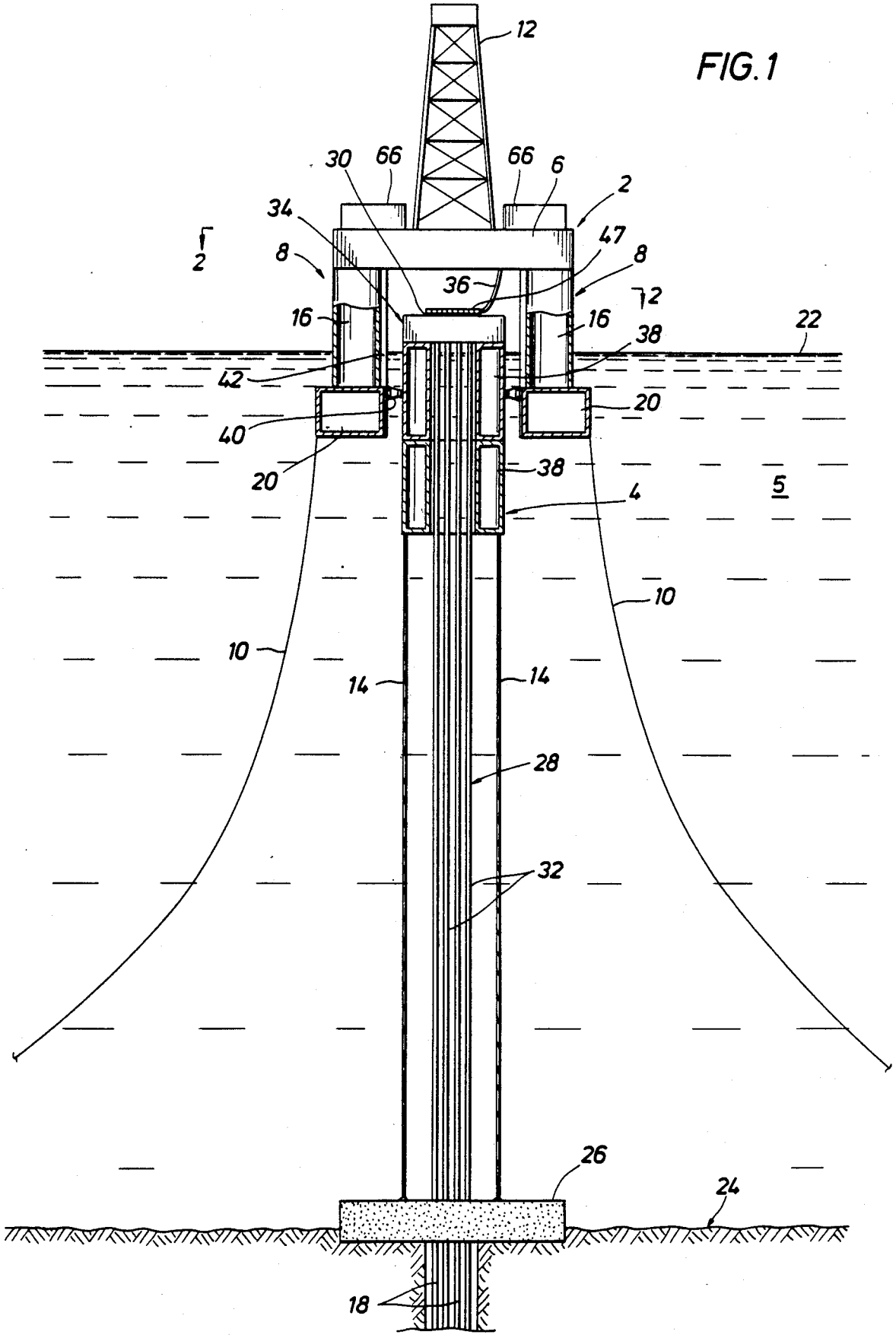
FIG. 1 is an elevational view, with part in cross-section, of the inventive floating/tensioned production system in which the risers are supported by the buoyant force of the buoyancy members of the tension leg platform.

FIG. 1 generally illustrates the inventive floating/-tensioned production system. The inventive system combines the elements of a semisubmersible floating production platform 2 and a tension leg platform ("TLP") 4, wherein semisubmersible platform 2 is situated generally above TLP 4 in a body of water 5. In the embodiment illustrated in FIG. 1, TLP 4 is roughly centered above the drill site and adjusted so that its production deck 34 is above water surface 22 but primarily below semisubmersible platform's working deck 6 and generally between buoyancy chambers 20 and vertical columns 16 of semisubmersible platform's flotation means 8. The components of TLP 4 and semisubmersible platform 2 are more fully described in the following paragraphs.

The components of semisubmersible platform 2 include working deck 6 supported by flotation means 8 and held in place by mooring lines 10. The equipment on working deck 6 includes drilling rig 12 and most other drilling equipment and production facilities 66 except the equipment described below which is located on TLP production deck 34. Flotation means 8 is preferably provided with at least one buoyancy chamber 20 similar to a pontoon capable of being ballasted and de-ballasted. Buoyancy chamber 20 supports one or more vertical columns 16 which support working deck 6. When buoyancy chamber 20 is de-ballasted, semisubmersible platform 2 can be floated to the drill site. Once semisubmersible platform 2 reaches the drill site, buoyancy chamber 20 of flotation means 8 is partially flooded, such that flotation means 8 will come to rest partially under water surface 22 while maintaining working deck 6 of semisubmersible platform 2 above water surface 22. The configuration of flotation means 8 is dependent upon the size, weight, and configuration of semisubmersible platform 2. For ease of illustration the preferred embodiment (as in FIG. 2) of flotation means 8 is shown having two buoyancy chambers 20 in the shape of pontoons. Each buoyancy chamber 20 is held to working deck 6 by two or more vertical columns 16. The use of multiple vertical columns 16 rather than a single, larger column or wall reduces loads caused by linear and non-linear wave forces. Semisubmersible platform 2 is held in place by mooring lines 10. In a preferred embodiment, spread mooring is used. Specifically, spread mooring uses several mooring lines 10 (often between 6 and 12 in number) attached in different locations around working deck 6 and positioned in different directions along seafloor 24. While semisubmersible drilling platforms are well-known in the field of offshore operations, one unique feature in the design of semisubmersible floating production platform 2 of the inventive production system is that the area below working deck 6 is substantially unobstructed to allow TLP 4 (or caisson 68 or 82 as described in connection with FIGS. 5 through 8) to be situated within such unobstructed area.

Figure 5:
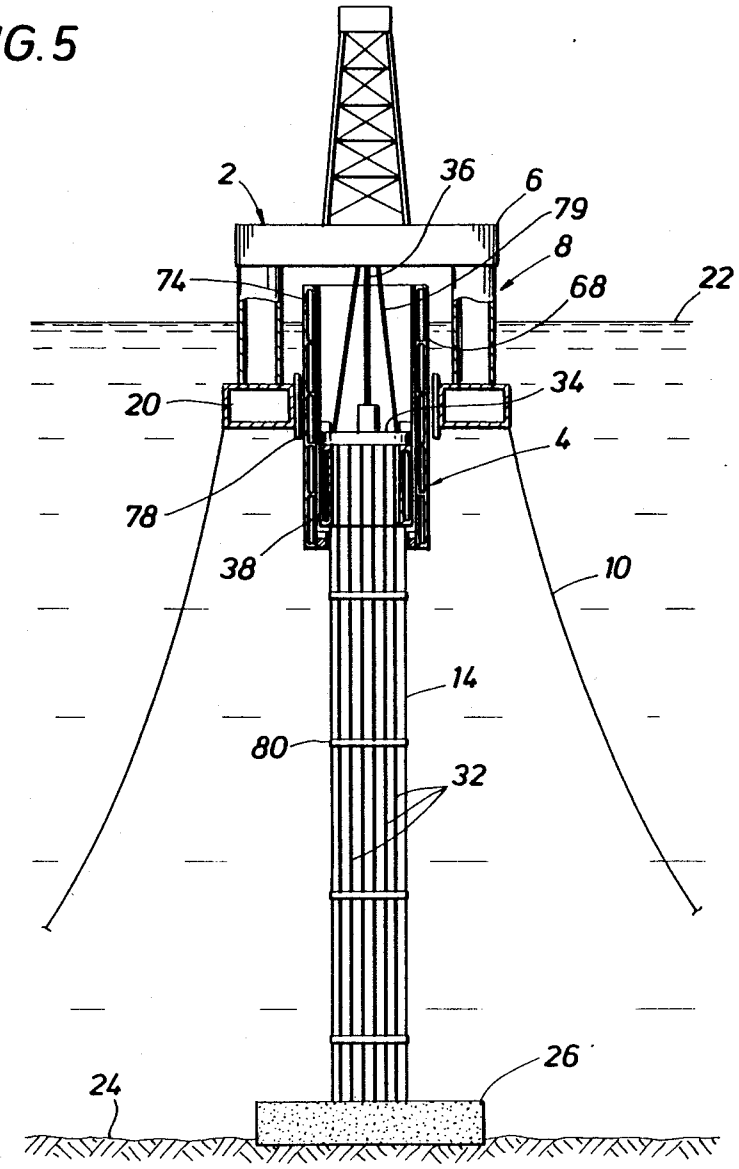
FIG. 5 is a elevational view of an alternative embodiment of the floating/tensioned production system using a below-surface tension leg platform surrounded by a retractable caisson.

One component of TLP 4 is foundation 26. Foundation 26 is situated on seafloor 24 above the drill site. Foundation 26 is constructed and anchored to seafloor 24 in such a manner as to provide sufficient anchorage for TLP 4 to withstand lateral and vertical forces arising from the vessel's response to the wave and tide movements. Extending upwardly from foundation 26 is riser system 28. Riser system 28 includes a plurality of risers 32 which are elongated tubular conduits used for guiding drill strings (not shown) into wellbores 18 and for directing produced fluid from wellbores 18 to surface wellheads 47 located on production deck 34. One skilled in the art will recognize that risers 32 may be supported solely by the tension provided from the buoyant force of buoyancy members 38 as shown in FIG. 1 or by lateral supports 80 connected to tethers 14 as shown in FIG. 5 or by a combination of tension and lateral supports 80.

Figure 2:
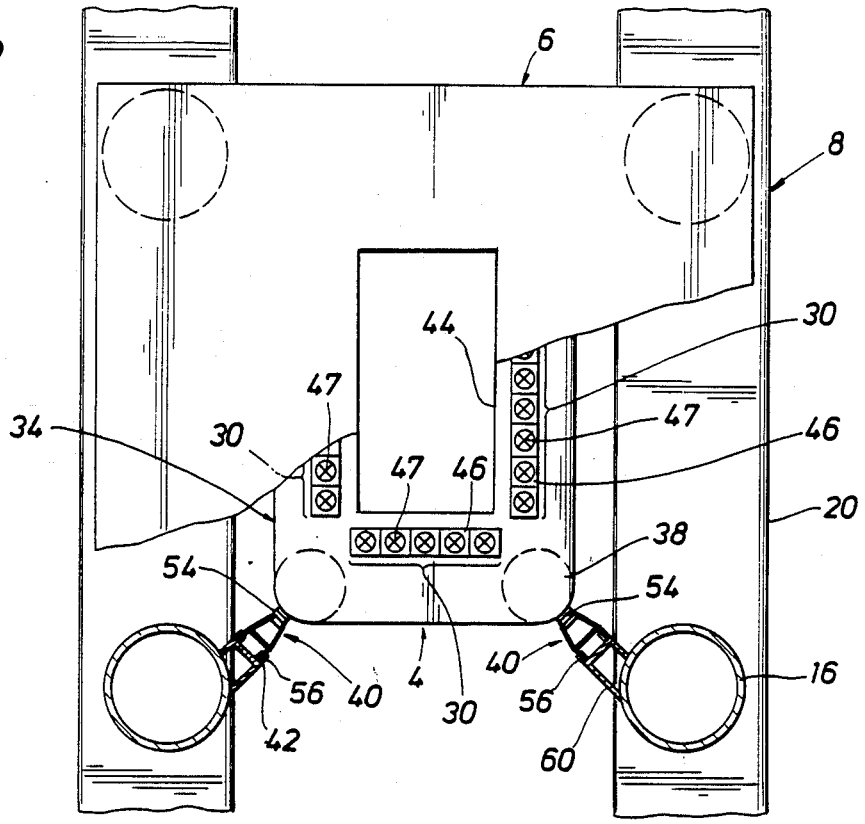
FIG. 2 is a plan view illustrating a preferred layout of the production deck of the tension leg platform, and the motion compensation system as it relates to the tension leg platform and the flotation means of the semisubmersible platform.

Surface wellheads 47 direct produced fluids from risers 32 to production facilities 66 on working deck 6 through one or more flexible flowlines 36 either directly or via a production manifold 30. Production manifold 30 is a fluid conduit used when the number of wellheads 47 differs from the number of flexible flowlines 36. Produced fluid is collected into production manifold 30 and directed to the appropriate flexible flowlines 36. Buoyancy members 38 support production deck 34 above water surface 22 in a preferred embodiment. Tethers 14 are the connecting links between production deck 34 and foundation 26. Tethers 14 extend upwardly from foundation 26 to an elevation which is below the maximum draft of buoyancy members 38, so that tethers 14 are tensioned by the buoyant force of buoyancy members 38. Tethers 14 may be connected to either production deck 34 or to buoyancy members 38. They may be connected about the perimeter of buoyancy members 38 as illustrated, or attached to the center of production deck 34, near moon pool 44 (FIG. 2). Tethers 14 may be metal tubular elements or cables and may be configured with a hollow water-tight center to provide added buoyancy. Any number of tethers 14 may be used.

The remaining components of the inventive production system include a means to compensate for the relative movement between TLP 4 and semisubmersible floating production platform 2. Such motion compensation means is described in conjunction with FIGS. 2, 3 and 4. An alternative motion compensation means is described in conjunction with FIG. 6.

FIG. 2 illustrates a basic plan for production deck 34. The actual layout of production deck 34 is dependent in part on the layout of the wellbore template (not shown) which is part of foundation 26. Production deck 34 is provided with moon pool 44. Moon pool 44 is a walled hole or well approximately in the center (although not necessarily) of production deck 34 through which the drilling assembly (not specifically shown) or other equipment may be passed during drilling, completions, or other operations. In a preferred embodiment, moon pool 44 would be roughly 30 feet by 65 feet in size to enable use of a twin drilling rig. Surrounding moon pool 44 are mounting supports 46 for surface wellheads 47 which may be interconnected by production manifold 30. In a preferred embodiment, mounting supports 46 are evenly spaced about moon pool 44, and are set sufficiently near moon pool 44 to prevent contact between risers 32 and the bottom surface of buoyancy members 38 when surface wind, wave, and current forces cause the floating/tensioned production system to shift laterally. In a preferred embodiment the spacing of wellbore template (not shown) is designed similarly to the spacing of wellheads 47 on production deck 34. The above layout is provided for illustration purposes only and is not intended to limit the scope of the inventive production system. One skilled in the art will readily recognize that any number of layouts and corresponding dimensions are feasible.

Figure 3:
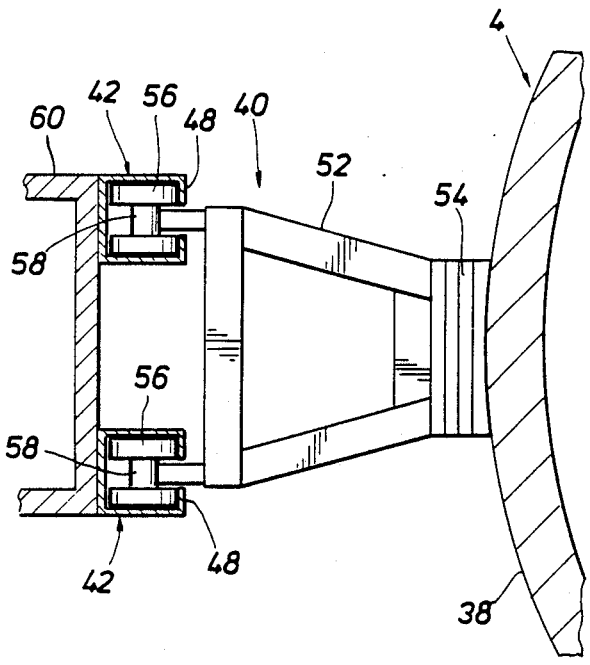
FIG. 3 is a plan view in partial cross-section of the floating/tensioned production system's relative motion compensator.
Figure 4:
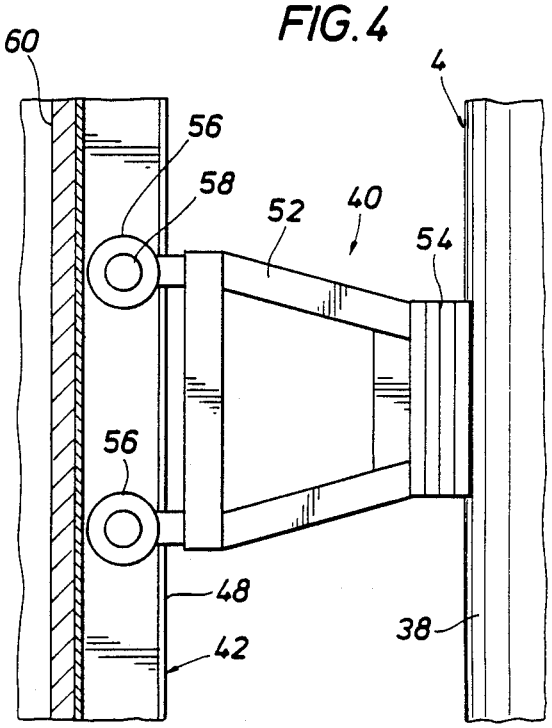
FIG. 4 is an elevational view of the relative motion compensator and guide rails used on a preferred embodiment of the floating/tensioned production system.

FIG. 2, along with FIGS. 3 and 4, also illustrates one means for compensating for the relative movement between semisubmersible floating production platform 2 and TLP 4. In a preferred embodiment the motion compensation means is completely passive, such that actively controlled motors, hydraulics or other equipment are not required. The motion compensation means illustrated in FIGS. 2, 3 and 4 includes centralizer dollies 40 and guide rails 42. The number of centralizer dollies 40 and guide rails 42 can vary. However, it is preferred that one centralizer dolly 40 and guide rail 42 are attached to TLP 4 and flotation means 8 respectively, and located at a probable contact point between TLP 4 and flotation means 8.

Centralizer dollies 40 are preferably attached to TLP 4 along buoyancy members 38, slightly above the center of gravity of TLP 4. Referring to FIGS. 3 and 4, centralizer dollies 40 are each constructed of support structure 52, flexblock 54, and wheels 56. Flexblock 54 attaches to buoyancy member 38. Flexblock 54 may be comprised of a series of metal strips attached to one another similarly to a leaf spring or may be constructed of elastomeric material and steel interleaves. The purpose of flexblock 54 is to compensate for the angular differences between centralizer dolly 40 on TLP 4 and guide rail 42 on flotation means 8. Support structure 52 extends from flexblock 54 outwardly, away from TLP 4. Opposite from flexblock 54 on support structure 52 are wheels 56. Wheels 56 are attached to support structure 52 in such a manner that axis 58 of each wheel 56 is substantially horizontal, enabling each wheel 56 to rotate when brought in contact with its mating guide rail 42.

Guide rails 42 may extend from the bottom of working deck 6 to the bottom of flotation means 8 along vertical columns 16 as illustrated in FIG. 1. Guide rails 42 are basically u-shaped with flanges 48 which envelop wheels 56. Guide rails 42 may be mounted either directly on flotation means 8, or on guide rail supports 60 attached to flotation means 8. Guide rail supports 60 adjust the angular orientation of guide rails 42 on flotation means 8 to match the angular orientation of support structure 52 as it extends from buoyancy members 38. Guide rail supports 60 are also illustrated in FIG. 2. Proper angular orientation of guide rails 42 will decrease the lateral loads on flexblock 54 and increase positioning capability.

Although not specifically illustrated, in one method of installation, semisubmersible floating production platform 2 is fabricated on shore using conventional shipbuilding techniques. Once fabricated, semisubmersible platform 2 is towed to the drill site and moored in place by mooring lines 10, as illustrated in FIG. 1. From the installed semisubmersible platform 2, foundation 26 of TLP 4 and well template (not shown) and tethers 14 are installed. Foundation 26 and well templates are brought out on barges and positioned underneath semisubmersible platform 2. From semisubmersible platform 2 each well template is lowered to ocean floor 24. Tethers 14 are preferably preinstalled using drilling rig 12 on semisubmersible platform 2. Due to the relatively small size of tethers 14, they may be run using drilling rig 12 and other drilling equipment (not shown). Once installed, tethers 14 may be supported in place by lines (not shown) from semisubmersible platform 2 until production deck 34 with buoyancy members 38 are installed.

Similar to semisubmersible platform 2, the upper portion of TLP 4, which includes production deck 34, buoyancy members 38, and the motion compensation means, is fabricated on shore as a single piece using conventional shipbuilding techniques and towed to location. Once the upper portion of TLP 4 reaches the drill site, buoyancy chambers 20 of semisubmersible platform 2 are de-ballasted so that much of flotation means 8 is floating above or near water surface 22. Buoyancy members 38 of TLP 4 are ballasted so that TLP 4 can be floated underneath working deck 6 and connected to semisubmersible platform 2 using centralizer dollies 40 and guide rails 42. The previously installed tethers 14 are then connected to production deck 34 and tensioned by de-ballasting buoyancy members 38. Semisubmersible platform 2 is lowered into final position by ballasting buoyancy chambers 20.

Drilling operations (also not specifically illustrated) are conducted from working deck 6 through moon pool 44 (See FIG. 2) of production deck 34 with either a subsea blowout preventer (not shown) using standard floating drilling practices or a surface blowout preventer (not shown). If required, the inventive floating/-tensioned production system may be winched laterally by mooring lines 10 in order to land the subsea blowout preventer in the appropriate well slot and to conduct drilling operations. The well is drilled and completed using normal floating drilling operations and risers 32 are installed.

FIG. 5 illustrates an alternative embodiment of the floating/tensioned production system. Rather than adjusting tethers 14 so that production deck 34 is above water surface 22, tethers 14 they are adjusted so that production deck 34 is below water surface 22, and a retractable caisson 68 is used. In a preferred embodiment retractable caisson 68 is open on its top end, and it completely encircles the perimeter of production deck 34. When in its fully extended position, caisson 68 sealingly engages with production deck 34, and caisson 68 extends upwardly to a point roughly 10 to 15 feet below the bottom of working deck 6 but above the water surface 22. To provide a substantially water-free work area on production deck 34 the interior of caisson 68 is evacuated using standard pumping equipment (not shown). Such evacuation also provides additional buoyancy which further tensions tethers 14.

One advantage of this alternative embodiment of the inventive system over the first described, preferred embodiment is that the TLP 4 may be decoupled from semisubmersible platform 2 in preparation for a severe storm. To do so, the interior work area of caisson 68 is filled with water and caisson 68 is retracted to its lowermost position. To replace any buoyancy-supplied tension that may be lost when caisson 68 is filled and retracted, buoyancy tanks 74 located within caisson 68 may be de-ballasted thereby keeping tethers 14 and risers 32 fully tensioned. When caisson 68 is fully retracted to its lowermost position, semisubmersible platform 2 and TLP 4 are decoupled. For additional clearance between semisubmersible platform 2 and TLP 4, it may be necessary to partially de-ballast buoyancy chambers 20 of flotation means 8. Retracting caisson 68 eliminates relative motion problems between semisubmersible platform 2 and TLP 4, and reduces design loads by having TLP 4 well below water surface 22 which minimizes the wave forces acting on TLP 4 and caisson 68.

Figure 6:
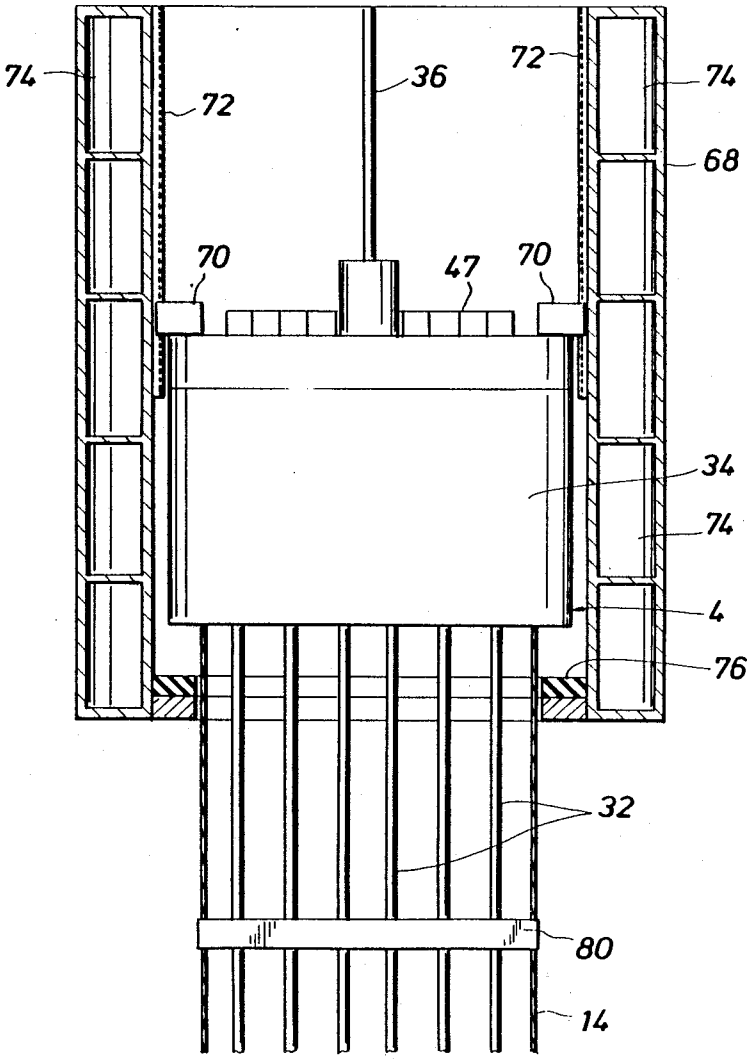
FIG. 6 is an elevational view, in partial cross-section which illustrates the details of the retractable caisson.

FIG. 6 illustrates the details of retractable caisson 68. Caisson 68 may be raised and lowered using a jacking system having jacking motors 70 and jacking rails 72 similar to that of a jackup drilling unit. Alternatively, caisson 68 may be raised or lowered by ballasting and de-ballasting buoyancy tanks 74 using conventional pumping systems (not shown). To provide a watertight seal, a large sealing element 76, preferably of an elastomeric material, is attached to or near the bottom of caisson 68. Sealing element 76 is adapted to sealingly mate with production deck 34 once caisson 68 is fully raised, making it possible for the interior of caisson 68 to be evacuated. All motors and valves and other such pumping equipment required to evacuate caisson 68 are, in a preferred embodiment, operated through an umbilical (not shown) from semisubmersible floating production platform 2. All components must be designed for underwater operation.

To control the relative motion between semisubmersible floating production platform 2 and TLP 4 when caisson 68 is raised, centralizer dollies 40 and guide rails 42 may be used substantially in the same manner as described in connection with FIGS. 2, 3, and 4. The primary difference being that centralizer dollies 40 are attached to caisson 68 rather than to buoyancy members 38. Alternatively, flotation means 8 of semisubmersible platform 2 may be provided with fenders 78 as shown in FIG. 5. In a preferred embodiment, fenders 78 are made of an elastomeric material. Taut stabilizer lines 79 may be run from the bottom of working deck 6 to production deck 34 to further centralize the TLP 4 beneath working deck 6. One reasonably skilled in the art will recognize that fenders 78, with or without stabilizer lines 79, may be used rather than the motion compensation system described in conjunction with FIGS. 2, 3, and 4, and in conjunction with the first described preferred embodiment.

Figures 7, 7A, 7B, 7C, 7D, 7E:
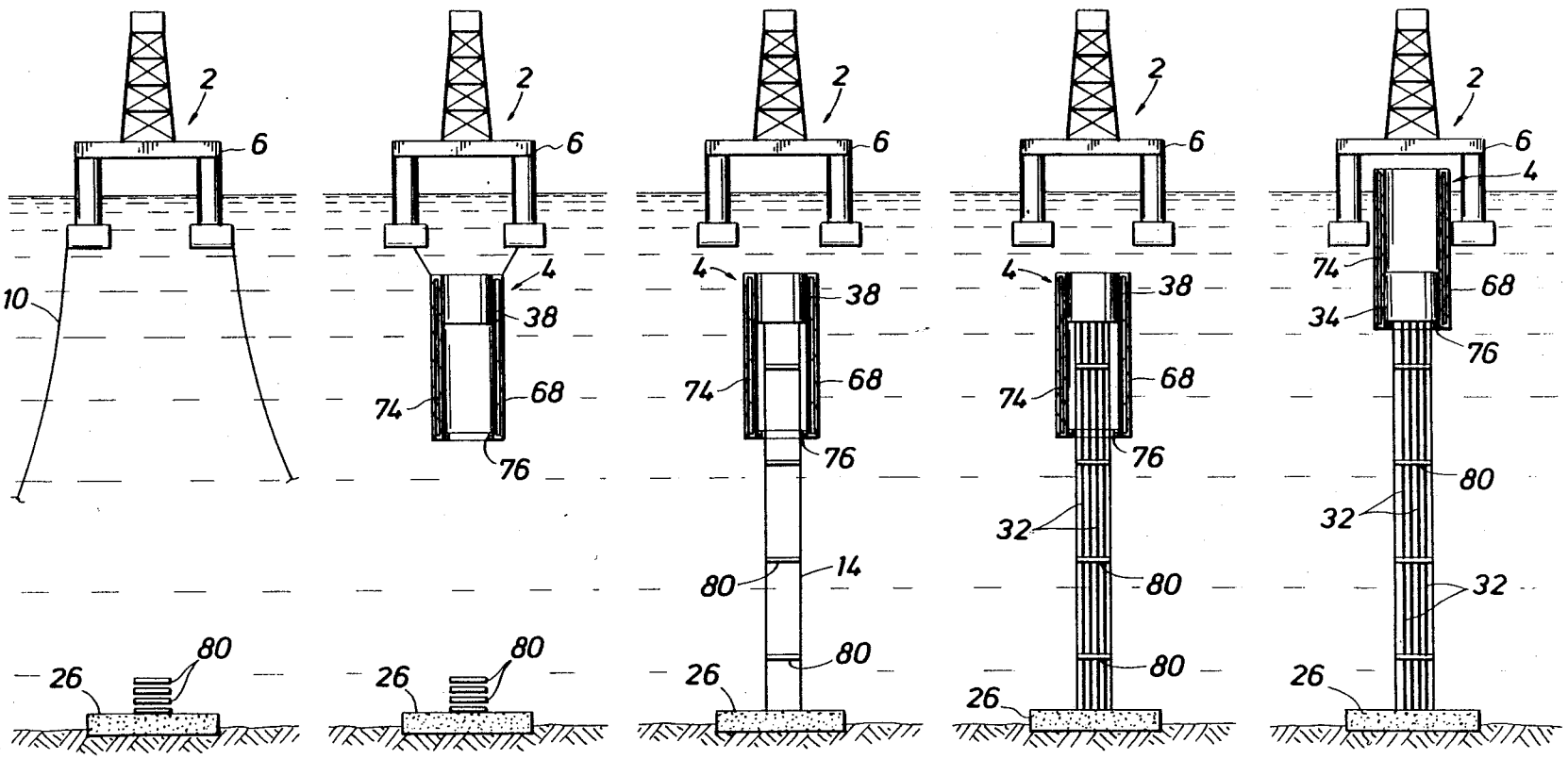
FIG. 7 (FIGS. 7A–7E) is a set of elevational views illustrating installation of the alternative embodiment of the floating/tensioned production system.

One method for installing this alternative embodiment of the inventive production system is illustrated in FIG. 7. In this illustration lateral supports 80 are used. However, one skilled in the art will recognize that, as in all embodiments described herein, risers 32 may be tensioned as described in conjunction with FIG. 1, or may be supported by lateral supports 80, or may be partially tensioned and supported with lateral supports 80. First, as was done with the first-disclosed preferred embodiment, semisubmersible floating production platform 2 and the upper portion of TLP 4, including caisson 68, are fabricated using conventional shipbuilding techniques. Once fabricated, semisubmersible platform 2 is towed to the drill site and anchored into position by mooring lines 10. From semisubmersible platform 2, foundation 26 and well templates (not shown) are installed, and lateral supports 80 may be stacked on foundation 26 (FIG. 7*a*). Then, the upper parts of TLP 4, with retractable caisson 68 in its lowermost position, are towed to location and positioned beneath working deck 6 (FIG. 7*b*). From semisubmersible platform 2, tethers 14 for TLP 4 are installed. Buoyancy tanks 74 in caisson 68 or buoyancy members 38 in TLP 4 are de-ballasted to tension tethers 14. Using tethers 14 as guidelines, lateral supports 80 may be lifted into place from semisubmersible platform 2, and locked against each tether 14 at the appropriate elevation (FIG. 7*c*). Each riser 32 is then run through slots (not shown) in lateral supports 80 (FIG. 7*d*). As each riser 32 is installed, buoyancy members 38 in TLP 4 are further de-ballasted to provide additional buoyancy to support the added weight. Finally, caisson 68 is raised (FIG. 7*e*) until sealing element 76 engages with production deck 34 and the water within caisson 68 is removed by conventional pumps (not shown) which are lowered from semisubmersible platform 2. To further adjust the tension in tethers 14, buoyancy tanks 74 within caisson 68 may be either ballasted or de-ballasted as necessary.

Figure 8:
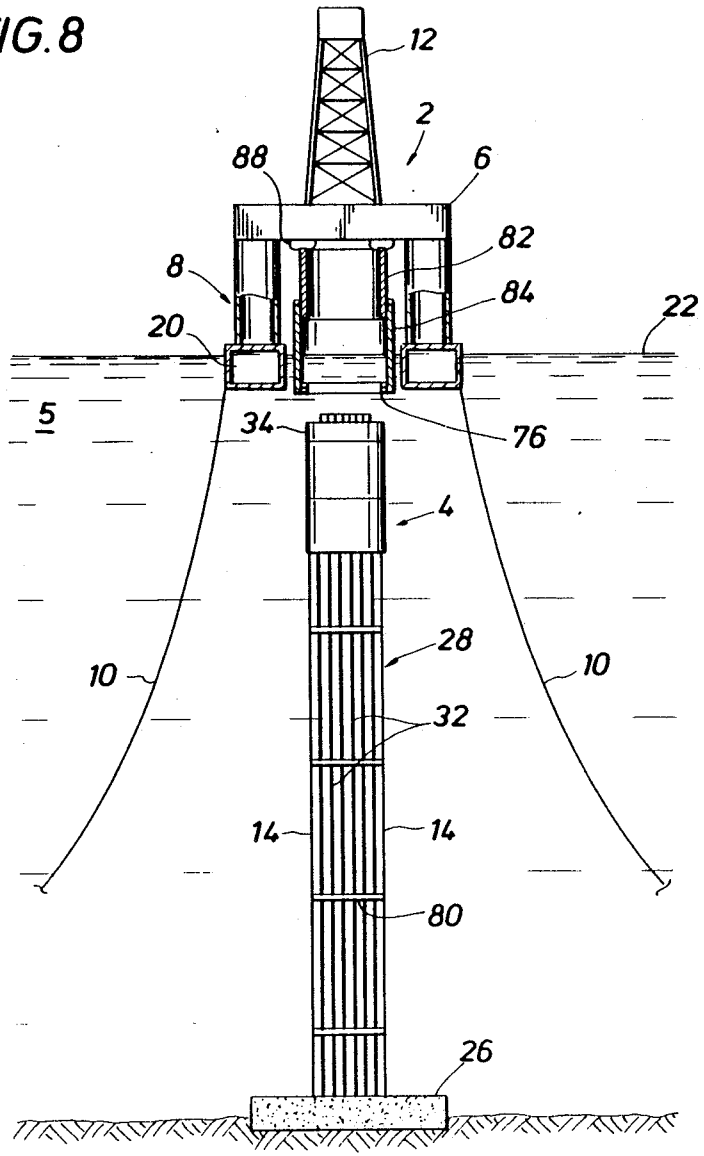
FIG. 8 is an elevational view illustrating an alternative embodiment of the inventive floating/tensioned production system with a caisson in which the caisson is suspended from the working deck of the semisubmersible platform.

FIG. 8 illustrates a third embodiment of the present invention. Tension leg platform 4 in this third embodiment is adjusted so that production deck 34 is below water surface 22 and flotation means 8, and non-retractable caisson 82 is used. Non-retractable caisson 82 is suspended from the bottom of working deck 6 and it extends downwardly to sealingly engage with production deck 34. The motion compensation means of this embodiment may be a watertight telescoping joint 84 in non-retractable caisson 82. Alternatively such means may be a flexible connector 88, which may be made of rubber or other flexible material, connecting non-retractable caisson 82 to working deck 6. To disengage TLP 4 from semisubmersible platform 2 in preparation for a severe storm, buoyancy chambers 20 of flotation means 8 are de-ballasted to raise working deck 6 and non-retractable caisson 82 away from production deck 34.

Figure 9:
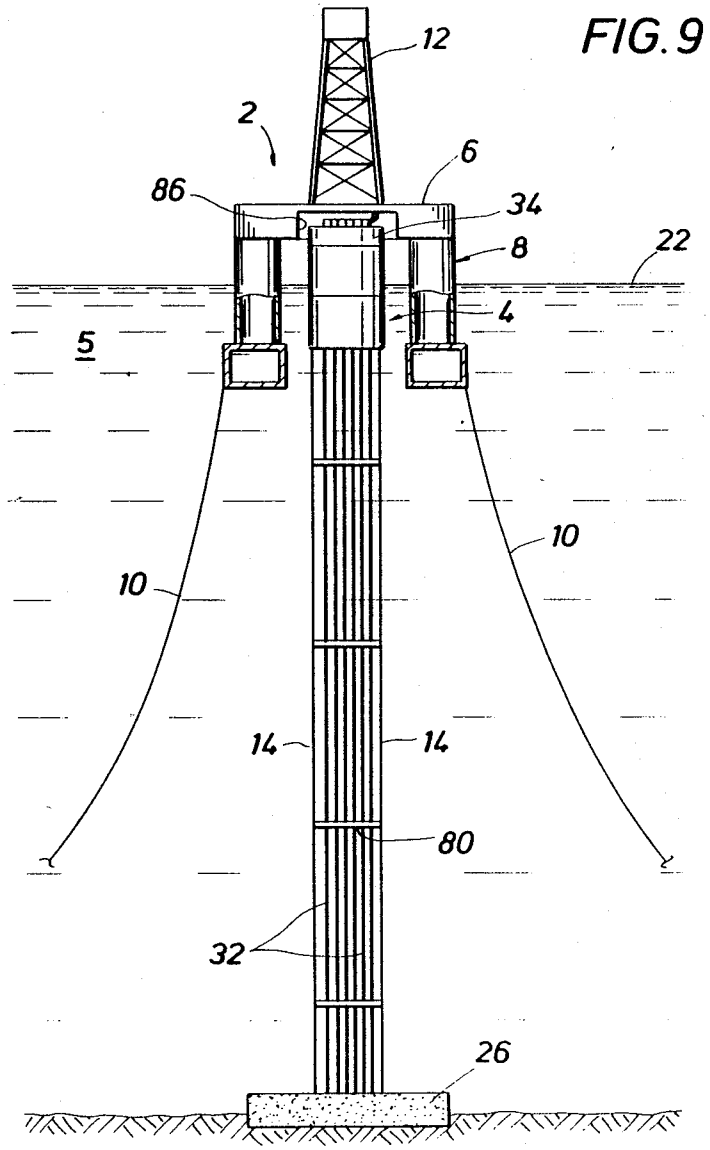
FIG. 9 is an elevational view illustrating an alternative embodiment of the inventive floating/tensioned production system in which the production deck of the tension leg platform extends upward into a cavity fabricated into the working deck of the semisubmersible platform.

FIG. 9 illustrates a fourth embodiment of the present invention in which cavity 86 is fabricated into working deck 6. Cavity 86 is configured to receive production deck 34. Tethers 14 of TLP 4 are adjusted such that the top of production deck 34 is held within cavity 86. Under normal operating conditions, flotation means 8 is adjusted to provide a sufficient air gap between the bottom of working deck 6 and the top of production deck 34 to prevent contact when production deck 34 is held in cavity 86 by tethers 14. This embodiment makes production deck 34 more accessible to the crew, normally working on working deck 6 and reduces the extent of washover. During severe storm conditions, as semisubmersible platform 2 and TLP 4 displace laterally from their normal operating position as a result of wind and wave conditions, TLP 4 with production deck 34 will move vertically relative to working deck 6 because of the fixed length of tethers 14, thus preventing contact between production deck 34 and working deck 6.

While the preferred embodiments of the present invention have been discussed above, it should be understood that the foregoing description is illustrative. The primary advantage of the present invention is that only the wellheads are heave-restrained. Other drilling and production equipment is located on a floating vessel and is allowed to heave in response to environmental forces. The resulting drilling and production system may be installed and operated at a substantial cost savings over other types of systems. Other embodiments of the invention can be employed without departing from the scope of the invention as set forth in the following claims.

We claim:

1. A drilling and production system for use at a drill site beneath a body of water having a surface, said drilling and production system comprising:

a semisubmersible platform having production facilities thereon and comprising a working deck with a bottom surface and being moored generally above said drill site;

a tension leg platform having a production deck supported by at least one buoyancy member, and at least one riser extending upwardly from said drill site to at least one wellhead located on said production deck, said tension leg platform being anchored by at least one tether at said drill site in such a manner that said production deck is supported below said surface of said body of water and generally beneath said working deck;

a caisson being configured and arranged to provide a substantially water-free working area on said production deck;

a means to compensate for relative movement between said semisubmersible platform and said tension leg platform; and at least one flexible flowline for directing produced fluid from said wellhead on said production deck to said production facilities.

2. The drilling and production system of claim 1 wherein said semisubmersible platform further comprises at least one flotation means for supporting said working deck, said flotation means being configured and arranged about the perimeter of said working deck leaving an unobstructed area beneath said working deck to enable positioning said caisson generally within said unobstructed area, said flotation means being further configured to be ballasted and de-ballasted.

3. The drilling and production system of claim 2 wherein said flotation means comprises at least one buoyancy chamber and at least one substantially vertical column supported on said buoyancy chamber and connecting said buoyancy chamber to said working deck.

4. The drilling and production system of claim 1 wherein said buoyancy member is adapted to be ballasted and de-ballasted.

5. The drilling and production system of claim 1 wherein said tether has a top end connected to said production deck.

6. The drilling and production apparatus of claim 1 wherein said tether has a top end connected to said at least one buoyancy member.

7. The drilling and production apparatus of claim 1 wherein said riser is tensioned by said buoyancy member.

8. The drilling and production apparatus of claim 1 further comprising lateral supports and wherein said riser is supported by lateral supports.

9. The drilling and production apparatus of claim 1 further comprising lateral supports and wherein said riser is both tensioned by said buoyancy member and supported by lateral supports.

10. The drilling and production system of claim 1 wherein said caisson is retractably attached to said production deck, said drilling and production system further comprising means for raising and lowering said caisson.

11. The drilling and production system of claim 10 wherein said caisson comprises:

a substantially vertical wall; and a sealing element attached to said substantially vertical wall in such a manner that as said caisson is raised said sealing element will sealingly engage with said production deck.

12. The drilling and production system of claim 10 wherein said means to compensate for relative movement between said semisubmersible platform and said tension leg platform comprises:

a centralizer dolly having at least one wheel, said centralizer dolly being attached to said caisson in such a manner that said wheel is directed toward a contact point between said semisubmersible platform and said caisson; and at least one guide rail being attached to said contact point on said semisubmersible platform in a substantially vertical manner, said guide rail being configured and arranged to envelope said wheel so that said wheel will rotate when there is relative movement between said semisubmersible platform and said tension leg platform.

13. The drilling and production system of claim 10 wherein said means to compensate for relative movement between said semisubmersible platform and said tension leg platform comprises at least one flexible fender attached to said semisubmersible platform on a contact point between said tension leg platform and said caisson.

14. The drilling and production system of claim 10 wherein said means for raising and lowering said caisson comprises buoyancy tanks adapted to be ballasted and de-ballasted.

15. The drilling and production system of claim 1 wherein said caisson is suspended from the bottom of said working deck.

16. The drilling and production system of claim 15 wherein said caisson comprises:

a substantially vertical wall extending downwardly from said working deck; and a sealing element adapted to sealingly engage with said production deck.

17. The drilling and production system of claim 15 wherein said means to compensate for relative movement between said semisubmersible platform and said tension leg platform comprises a telescoping joint within said substantially vertical wall of said caisson.

18. The drilling and production system of claim 15 wherein said means to compensate for relative movement between said semisubmersible platform and said tension leg platform comprises a flexible connector suspending said caisson from said working deck.

19. A drilling and production system for use at a drill site beneath a body of water having a floor and a surface, said drilling and production system comprising:

a semisubmersible platform having production facilities thereon and comprising a working deck having an outer perimeter, at least one flotation means supporting said working deck and being configured and arranged about said outer perimeter leaving a substantially unobstructed area beneath said working deck and within said perimeter, said flotation means being adapted to be ballasted and de-ballasted, and mooring lines for anchoring said working deck at said drill site;

a tension leg platform comprising a production deck, at least one buoyancy member for supporting said production deck, said buoyancy member being adapted to be ballasted and de-ballasted, a foundation anchored on said floor of said body of water above said drill site, at least one riser extending upwardly from said drill site to at least one wellhead located on said production deck, and at least one tether adjusted to hold said production deck above said foundation and below said surface of said body of water;

a caisson being configured and arranged to provide a substantially water-free working area on said production deck;

means to compensate for relative movement between said semisubmersible platform and said tension leg platform; and at least one flexible flowline for directing fluid from said wellhead on said production deck to said production facilities.

20. The drilling and production system of claim 19 wherein said flotation means comprises at least one buoyancy chamber and at least one substantially vertical column supported on said buoyancy chamber and connecting said buoyancy chamber to said working deck.

21. The drilling and production system of claim 19 wherein said tether has a top end connected to said production deck.

22. The drilling and production apparatus of claim 19 wherein said tether has a top end connected to said buoyancy member.

23. The drilling and production apparatus of claim 19 wherein said riser is tensioned by said buoyancy member.

24. The drilling and production apparatus of claim 19 further comprising lateral supports and wherein said riser is supported by said lateral supports.

25. The drilling and production apparatus of claim 19 further comprising lateral supports and wherein said riser is both tensioned by said buoyancy member and supported by said lateral supports.

26. The drilling and production system of claim 19 wherein said production deck is held below said flotation means.

27. The drilling and production system of claim 19 wherein said caisson is retractably attached to said production deck, said drilling and production system further comprising means for raising and lowering said caisson.

28. The drilling and production system of claim 27 wherein said caisson comprises:

a substantially vertical wall; and a sealing element attached to said substantially vertical wall in such a manner that as said caisson is raised said sealing element will sealingly engage with said production deck.

29. The drilling and production system of claim 27 wherein said means for raising and lowering said caisson comprises buoyancy tanks.

30. The drilling and production system of claim 27 wherein the means to compensate for relative movement between said semisubmersible platform and said tension leg platform comprises:

a centralizer dolly being attached to said caisson, said centralizer dolly comprising at least one wheel directed toward a contact point between said flotation means and said caisson; and at least one guide rail attached to said flotation means in a substantially vertical manner at said contact point, said guide rail being configured and arranged to envelope said wheel so that said wheel will rotate when there is relative movement between said tension leg platform and said semisubmersible platform.

31. The drilling and production system of claim 27 wherein said means to compensate for relative movement between said semisubmersible platform and said tension leg platform comprises a flexible fender attached to said flotation means at a contact point between said semisubmersible platform and said caisson.

32. The drilling and production system of claim 19 wherein said caisson is suspended from the bottom of said working deck.

33. The drilling and production system of claim 32 wherein said caisson comprises:

a substantially vertical wall extending downwardly from said working deck; and a sealing element adapted to sealingly engage with said production deck.

34. The drilling and production system of claim 32 wherein said means to compensate for relative movement between said semisubmersible platform and said tension leg platform comprises a telescoping joint within said substantially vertical wall of said caisson.

35. The drilling and production system of claim 32 wherein said means to compensate between said semisubmersible platform and said tension leg platform comprises a flexible connector suspending said caisson from said working deck.

36. A drilling and production system for use at a drill site beneath of a body of water having a floor and a surface, said drilling and production system comprising:

a plurality of mooring lines;

a working deck having a bottom and being anchored by said mooring lines at a location generally centered over said drill site;

at least one flotation means for supporting said working deck above the surface of said body of water by a buoyant force, said flotation means being configured and arranged so that an unobstructed area exists substantially centered beneath said working deck, said flotation means being adapted to be ballasted and de-ballasted, whereby said flotation means may be sufficiently de-ballasted to support said working deck above said surface of said body of water so that an air gap exists between said bottom of said working deck and said surface of said body of water;

a production deck having at least one wellhead thereon;

at least one buoyancy member for supporting said production deck, said buoyancy member being adapted to be ballasted and de-ballasted;

a foundation anchored on said floor of said body of water at said drill site;

at least one riser extending upwardly from said drill site to said wellhead on said production deck;

at least one tether configured and adjusted to maintain said production deck above said foundation and below said surface of said body of water;

at least one flexible flowline for directing produced fluid from said wellhead on said production deck to said production facilities;

a caisson being configured and arranged to provide a substantially water-free working surface on said production deck; and means to compensate for relative movement between said production deck and said working deck.

37. The drilling and production system of claim 36 wherein said flotation means comprises at least one buoyancy chamber and at least one substantially vertical column supported on said buoyancy chamber and connecting said buoyancy chamber to said working deck.

38. The drilling and production system of claim 36 wherein said tether has a top end connected to said production deck.

39. The drilling and production apparatus of claim 36 wherein said tether has a top end connected to said buoyancy member.

40. The drilling and production apparatus of claim 36 wherein said riser is tensioned by said buoyancy member.

41. The drilling and production apparatus of claim 36 further comprising lateral supports and wherein said riser is supported by said lateral supports.

42. The drilling and production apparatus of claim 36 further comprising lateral supports and wherein said riser is both tensioned by said buoyancy member and supported by said lateral supports.

43. The drilling and production system of claim 36 wherein said production deck is held below said flotation means by said tether.

44. The drilling and production system of claim 36 wherein said caisson is retractably attached to said production deck, said drilling and production system further comprising means for raising and lowering said caisson.

45. The drilling and production system of claim 44 wherein said caisson comprises:

a substantially vertical wall; and a sealing element attached to said substantially vertical wall in such a manner that as said caisson is raised said sealing element will sealingly engage with said production deck.

46. The drilling and production system of claim 44 wherein said means to compensate for relative movement between said production deck and said working deck comprises:

a centralizer dolly having at least one wheel attached to said caisson in such a manner that said at least one wheel is directed toward a contact point between said flotation means and said caisson; and at least one guide rail being attached to said contact point in a substantially vertical manner, said guide rail being configured and arranged to envelop said wheel so that said wheel will rotate when there is relative movement between said production deck and said working deck.

47. The drilling and production system of claim 44 wherein said means to compensate for relative movement between said production deck and said working deck comprises a flexible fender attached to said flotation means at a contact point between said caisson and said flotation means.

48. The drilling and production system of claim 44 wherein said means for raising and lowering said caisson comprises buoyancy tanks adapted to be ballasted and de-ballasted.

49. The drilling and production system of claim 36 wherein said caisson is suspended from said bottom of said working deck.

50. The drilling and production system of claim 49 wherein said caisson comprises:

a substantially vertical wall suspended from said working deck; and a sealing element adapted to sealingly engage with said production deck.

51. The drilling and production system of claim 49 wherein said means to compensate for relative movement between said production deck and said working deck comprises a telescoping joint within said substantially vertical wall of said caisson.

52. The drilling and production system of claim 49 wherein said means to compensate between said production deck and said working deck comprises a flexible connector suspending said caisson from said working deck.

* * * * *